US005249619A

United States Patent [19]

Meacock, II et al.

[11] Patent Number: 5,249,619

[45] Date of Patent: Oct. 5, 1993

[54] BRAKE ELEMENT AND A PREPARATION PROCESS THEREFOR

[75] Inventors: Leslie A. Meacock, II, Emmaus; Donald E. McVicker, Allentown, both of Pa.

[73] Assignee: Mack Trucks, Inc., Allentown, Pa.

[21] Appl. No.: 785,311

[22] Filed: Oct. 30, 1991

[51] Int. Cl.[5] ..... B22C 3/00; B22D 27/00

[52] U.S. Cl. ..... 164/58.1; 164/72

[58] Field of Search ..... 164/58.1, 72

[56] References Cited

U.S. PATENT DOCUMENTS 1,153,231 9/1915 Jacobs .
3,087,814 4/1963 Smiley .
3,415,307 3/1966 Schuh et al. .
3,658,115 4/1972 Ryntz, Jr. et al. .
3,703,922 11/1972 Dunks et al. .
3,765,876 10/1973 Moore .
3,877,141 4/1975 Bradshaw et al. .
4,760,900 8/1988 Shima et al. .
4,779,668 10/1988 Nagel et al. .

OTHER PUBLICATIONS

*Metals Handbook, Ninth Edition vol. 1, Properties and Selection: Iron and Steel,* American Society for Metals, Metals Park, Ohio. Sep. 1978; pp. 11–56.

*Primary Examiner*—Kuang Y. Lin
*Attorney, Agent, or Firm*—Rothwell, Figg, Ernst & Kurz

[57] ABSTRACT

A braking element which has an uninterrupted, unitary structure and is prepared in one step is provided. By coating a molding surface used to mold the braking element with a certain amount of nodularizing agent, the molten iron poured into the mold is transformed into an uninterrupted, unitary structure. The amount of nodularizing agent is such that a ductile iron support surface results from the nodularizing agent inoculating the initially poured iron. However, the amount is also such that a grey iron friction braking surface results from the subsequently poured iron which does not come in contact with the nodularizing agent.

7 Claims, 1 Drawing Sheet

BRAKE ELEMENT AND A PREPARATION PROCESS THEREFOR

BACKGROUND

1. Field of the Invention

The invention generally relates to braking elements, especially brake drums, and processes for preparing the elements.

2. Background of the Invention

Generally, a braking element comprises two surfaces. One surface is a support surface which acts as an interface for attaching the braking element to a brake assembly via a brake shoe or the like. The other surface is a friction braking surface which is attached to the support surface. The friction braking surface usually provides the braking friction through contact with another surface, e.g., brake plate or brake lining.

The different properties required for each surface usually necessitate that a different type of material be used for each surface. For cast iron brake elements, grey cast iron or "grey iron" and ductile cast iron or "ductile iron", or steel are typically employed. Grey iron is used to prepare friction braking surfaces because of its stable coefficient of friction and excellent wear resistance. U.S. Pat. No. 4,760,900 to Shima et al. Ductile iron or steel is employed to prepare support surfaces because of its ductile strength characteristics. These characteristics allow the ductile iron to withstand the stress and pressures associated with interaction and attachment to the operating elements of an vehicle's braking system assembly.

As a result of using two types of materials, it is conventional practice in the brake art to prepare each surface separately and then bond them together in some fashion to form the braking element. For instance, the '900 patent to Shima et al. discloses metallurgically bonding a friction braking surface of pre-cast grey iron to a high strength metal support surface. As a result, two process steps are employed, i.e., the first step being the preparation of the two surfaces and the second step being attachment of the two surfaces.

In U.S. Pat. No. 3,087,814 to Smiley, a somewhat different two step method is disclosed. Specifically, Smiley discloses applying to a molding surface one layer of metal powder to which is then applied a second layer of powder comprising a "friction" mixture, e.g., iron, graphite and molybdenum. The two layers are then briquetted under pressures in the range of 60,000 to 100,000 pounds per square inch. The resulting briquetting produces coherent self-containing layers which are coextensively related and connected to each other through mechanical bonding. The first layer forms the ductile support layer and the second layer forms the friction braking layer. However, as evident from the description above, not only is a briquetting procedure required, but two processing steps are required in adding the powders necessary to form the braking element.

SUMMARY OF THE INVENTION

The cast iron brake element according to this invention comprises an uninterrupted, unitary structure, having a support surface and a friction braking surface wherein the support surface comprises ductile iron and the friction surface comprises grey iron.

The process for producing the cast iron brake element described above comprises (a) coating a molding surface of a brake element casting mold with a nodularizing agent;

(b) pouring molten iron onto said coated molding surface; and (c) casting said molten iron;

wherein the nodularizing agent in (a) is present in an amount sufficient to form a ductile iron surface from an initial amount of iron poured in (b), but wherein the iron poured subsequent to the initial amount forms a grey iron surface.

As a result of the process described above, the production of ductile iron is initiated as the molten iron initially comes into contact with the treated mold walls. However, because there is a limited amount of the nodularizing agents present, only a certain depth of the molten iron will be transformed into ductile iron. As additional molten metal fills the mold cavity the balance will form grey iron. The result then is an uninterrupted, unitary braking element, wherein the element will have the desired higher strength support surface and the thermally conductive friction braking surface.

DETAILED DESCRIPTION OF THE INVENTION

Figure 1:
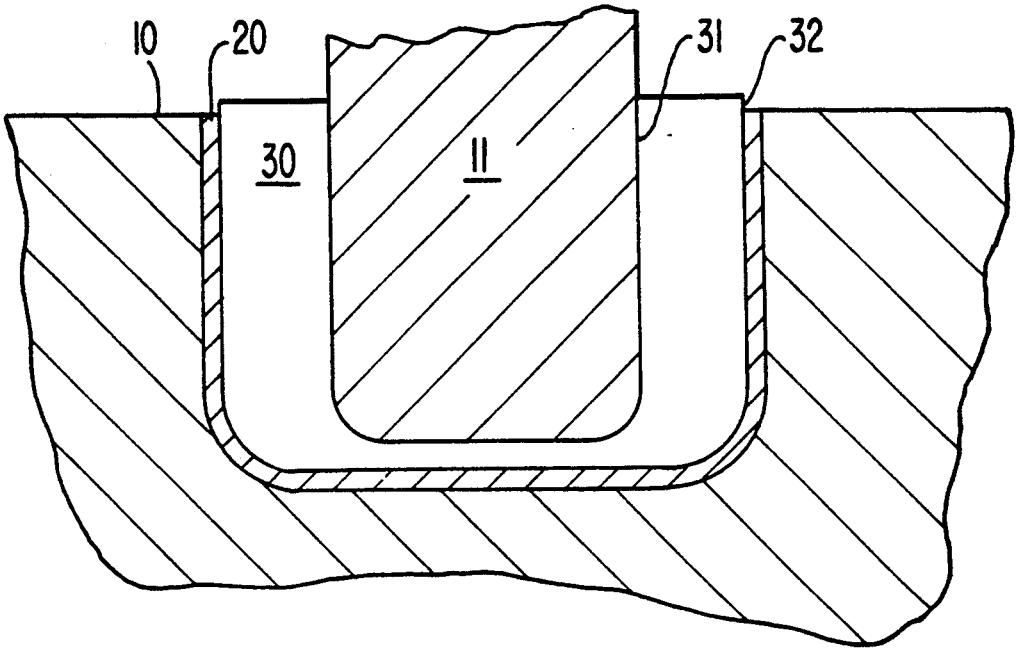
FIG. 1 is a partly schematic cross-sectional view, with portions broken away, of a brake component being formed in accordance with the present invention.

As indicated above, the braking element of the invention comprises an uninterrupted, unitary structure. By the term "uninterrupted, unitary structure" it is meant that the structure comprises one part prepared from one composition, as opposed to either a structure comprising two parts which have been adhered together, or a structure comprising two compositions which have been layered and then compressed together in a coextensive relationship.

Raw material suitable for preparing ductile iron is suitable for preparing the braking element of the invention. The raw material should have a low sulfur content. The raw material for the preferred embodiment has no more than about 0.02% by weight sulfur of the total raw material weight. For more preferred embodiments, the raw material has no more than about 0.01% by weight sulfur. Methods of reducing sulfur content in the raw materials are well known and include basic melting, and/or the use of calcium carbide as a desulphurizer. U.S. Pat. No. 3,765,876 to Moore and *Metals Handbook, Volume* 1, *Properties and Selection: Irons and Steels* (9th ed. 1978). Failure to reduce the sulfur content prior to processing the raw material leads to the use of excessive amounts of expensive nodularizing agents and may impair melting efficiency.

Because the brake element of the invention includes surfaces of both grey iron and ductile iron, the content of the iron used as the raw starting material should be selected to accommodate efficient production of both types, as well as accommodate their different properties. Because both grey and ductile iron are usually produced from the same types of raw materials, this can easily be done. Table I below indicates ranges of suitable element amounts. The percentages indicated below are percentages by weight. The remaining balance of the raw material is iron.

TABLE I

| Element | Composition, % Grey iron | Ductile iron |
|---|---|---|
| Total Carbon (TC) | 3.25 to 3.50 | 3.50 to 3.80 |
| Silicon | 1.80 to 2.30 | 2.00 to 2.80 |
| Manganese | 0.60 to 0.90 | 0.30 to 1.00 |
| Chromium | 0.05 to 0.20 | 0.08 maximum |
| Nickel | 0.05 to 0.20 | 0.05 to 0.20 |
| Molybdenum | 0.05 to 0.10 | 0.01 to 0.10 |
| Copper | 0.15 to 0.40 | 0.15 to 0.40 |
| Phosphorus | 0.12 maximum | 0.08 maximum |
| Sulfur | 0.15 maximum | 0.02 maximum |
| Cerium | none | 0.005 to 0.020 (optional) |
| Magnesium | none | 0.03 to 0.05 |

The raw material should also have a content which provides grades of iron suitable for the type of support and friction braking surface desired. For instance, the raw material should be sufficient to produce a grade of grey iron in the range of G2500 to G3500b, as set by SAE standard J431c. For braking elements which will undergo heavy duty service, raw materials for the preferred embodiment should be capable of producing a grade of G3500b. The material also should be selected to produce a ductile iron having a grade in the range of SAE J434 Grades D4018 to D4512. Selection of raw materials suitable for producing these grades is well within the skill of the ordinary artisan. *Metals Handbook*, supra. Once the desired raw material is selected, it is placed in conventional ladles and iron processing apparatus and heated to a pouring temperature between 2500° and 2600° F. (about 1370° to about 1430° C.). The molten iron is then continuously poured into a brake element mold which has been coated with a nodularizing agent.

Suitable nodularizing agents include, but are not necessarily limited to, iron-containing agents, such as ferrosilicon alloys, containing iron, calcium, magnesium and silicon. Alloys containing lithium, strontium, barium, cerium, lanthanum and thorium are also suitable. The agents may be used alone or in combination with other agents. In a preferred embodiment of the invention, a combination of a ferrosilicon alloy and magnesium agents is used.

A suitable binder is used to formulate nodularizing agent into a coating composition. Conventional binders such as Type O sodium silicate are suitable.

The amount of nodularizing agent should be sufficient to produce ductile iron from only the initial molten iron poured into the coated mold. The amount should not be such that ductile iron is also produced from the molten iron which follows the initial poured iron. In other words, the amount of nodularizing agent should be such that when the braking element is cast, a ductile iron support surface is produced from the initially poured iron. However, the amount should also be such that the molten iron which subsequently follows the initially poured iron forms a surface comprising substantially grey iron. By "surface," it is meant the outermost surface of the iron as well as a certain thickness underlying the surface. The amount of nodularizing agent is a function of both the surface area of the mold and the size of the casting. The nodularizing agent covers the surface of the mold which corresponds to the ductile surface of the braking element. On brake drums, the thickness of resultant ductile iron is at least the thickness of the mounting flange, e.g., within the range of from about 0.1 cm to about 1 cm. The thickness of the coating on the mold of nodularizing agent necessary to produce the desired thickness of ductile iron may be in the range of from about 10% to about 100% of the desired thickness of ductile iron. The molten iron is then poured into the coated mold using standard pouring techniques. According to this invention, only one pour per mold is necessary, with the initially poured iron undergoing nodularization and the latter portion of the continuous flow of poured iron forming grey iron.

Upon casting the molten iron a braking element comprising a ductile iron support surface and a grey iron friction braking surface is produced.

The braking element can be embodied in various forms. For instance, it may be in the form of a brake plate or a brake drum. It may also be used in clutches.

A brake drum being formed in accordance with the invention is illustrated in FIG. 1. Specifically, a molding surface 10 having a coating 20 comprising nodularizing agent is employed to cast mold casting 30 into a brake drum. A second molding piece 11 is also employed, but should not be treated with nodularizing agent. Molding piece 11 is used to mold casting 30 so that the casting's inner surface 31 will form a friction braking surface comprising grey iron.

Figure 2:
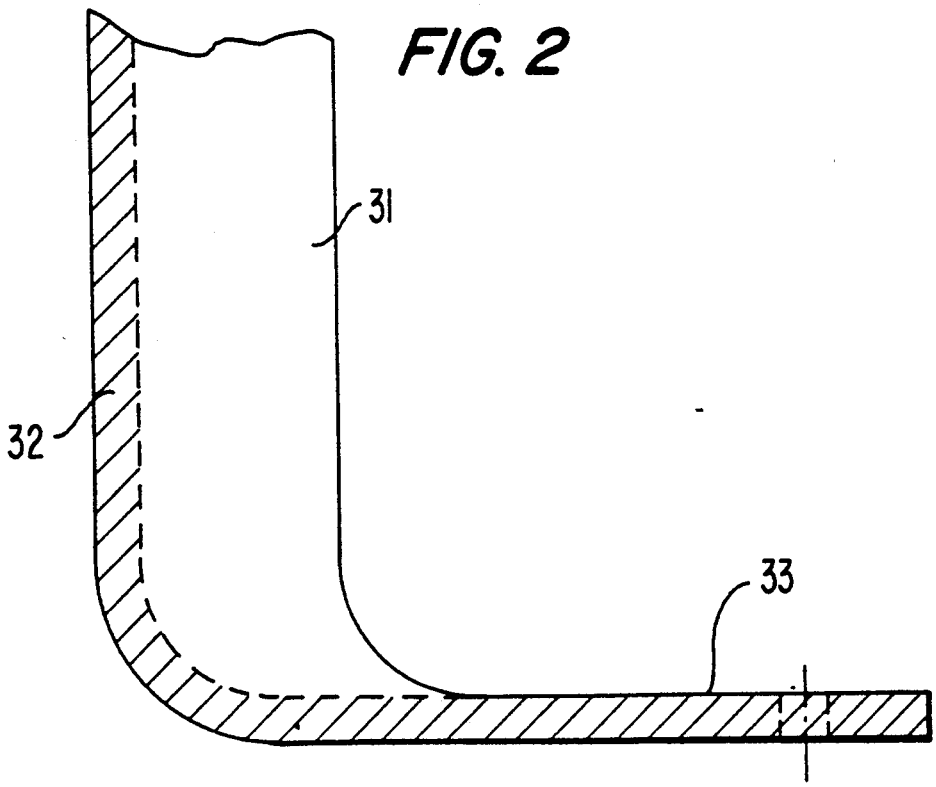
FIG. 2 is a partly schematic cross-sectional view, with portions broken away, of part of a brake component according to the invention.

A partial section of the resulting brake drum is illustrated in FIG. 2. Area 32 of the uninterrupted, unitary element comprises ductile iron as a result of molding contact with nodularizing coating 20. Area 31 comprises substantially grey iron as a result of little or no contact with nodularizing agent. The drum's mounting flange, which is a part of the drum's ductile outer surface, is illustrated as 33 in FIG. 2.

What is claimed is:

1. A process for producing a cast iron brake element having an uninterrupted, unitary structure wherein the process comprises:

(a) coating a molding surface of a brake element casting mold with a nodularizing agent;

(b) pouring molten iron onto said coated molding surface; and (c) casting said molten iron in said mold;

wherein the nodularizing agent in (a) is present in an amount sufficient to form a ductile iron surface from an initial amount of iron poured in (b), but wherein the iron poured subsequent to the initial amount forms a grey iron surface, so as to provide a cast iron brake element having an uninterrupted, unitary structure, the brake element further including a support surface comprising ductile iron and a friction braking surface comprising grey iron, wherein the coating step in (a) comprises applying to the molding surface a nodularizing agent having a thickness in the range of from about 10% to about 100% of thickness of said ductile iron.

2. A process according to claim 1 wherein the coating step set forth in (a) comprises applying to the molding surface a nodularizing agent which includes ferrosilicon and magnesium.

3. A process according to claim 1 wherein the ductile iron produced in casting step (c) has a thickness in the range of from about 0.1 cm to about 1 cm.

4. A process according to claim 1 wherein the pouring step in (b) comprises pouring molten iron having no more than 0.02% by weight sulfur.

5. A process according to claim 1 wherein the casting step in (c) comprises casting said molten iron at a temperature of about 1370°–1430° C.

6. A process according to claim 1 wherein said coating step in (a) comprises coating a molding surface of a brake drum casting mold, and wherein said molten iron is cast into a brake drum in step (c).

7. A process according to claim 1 further comprising employing a second molding surface wherein said surface has not been coated with nodularizing agent and said surface molds said friction braking surface.

* * * * *